US006362735B2

(12) United States Patent
Sicuranza

(10) Patent No.: US 6,362,735 B2
(45) Date of Patent: Mar. 26, 2002

(54) VEHICLE DOOR STOP SAFETY SYSTEM

(76) Inventor: Rosario G. Sicuranza, 2870 Rte. #104, East Quogue, NY (US) 11942

( * ) Notice: Subject to any disclaimer, the term of this patent is extended or adjusted under 35 U.S.C. 154(b) by 0 days.

(21) Appl. No.: 09/737,131

(22) Filed: Dec. 14, 2000

Related U.S. Application Data

(63) Continuation-in-part of application No. 09/489,121, filed on Jan. 21, 2000.

(51) Int. Cl.[7] ..... G08B 13/18
(52) U.S. Cl. ..... 340/556; 340/557; 250/221
(58) Field of Search ..... 340/556, 555, 340/557, 545.3, 686.6, 573.1, 551, 565, 540, 545.1; 359/708; 250/221, 222.1

(56) References Cited

U.S. PATENT DOCUMENTS

| | | | | |
|---|---|---|---|---|
| 4,379,289 A | | 4/1983 | Peek | |
| 4,539,474 A | | 9/1985 | Takahata | |
| 4,853,531 A | | 8/1989 | Rejc | |
| 4,922,094 A | | 5/1990 | Hatanaka et al. | |
| 5,191,268 A | | 3/1993 | Duhame | |
| 5,326,967 A | | 7/1994 | Herrmann et al. | |
| 5,331,677 A | | 7/1994 | Matsuoka | |
| 5,424,717 A | | 6/1995 | Platt et al. | |
| 5,936,232 A | | 8/1999 | Saretzky | |
| 5,969,603 A | | 10/1999 | Wang | |
| 6,080,981 A | | 6/2000 | Payne | |
| 6,218,940 B1 | * | 4/2001 | Rejc et al. | 340/556 |
| 6,271,512 B1 | * | 8/2001 | Lewis | 250/221 |

OTHER PUBLICATIONS

Article "Minivan King Takes Another Giant Leap: DaimlerChrysler Introduces More Minivan First and Unveils Its Next Generationof Chrysler and Dodge Minivans" dates Jan. 10, 2000 taken from http://de.news.yahoo.com/000110/36/gtbb.html.

Article "Dodge & Chrysler Minivans—2001 Dodge Grand Caravan ES" taken from http://www.auto.com2000autoshow/slideshow/dodge_minivan_prod/photo1.htm.

* cited by examiner

*Primary Examiner*—Anh La
(74) *Attorney, Agent, or Firm*—Dilworth & Barrese, LLP

(57) ABSTRACT

A vehicle door stop safety system for preventing closing of a door of a vehicle when an object moves between the open door and the body of the vehicle. The vehicle door stop safety system includes a field producing assembly for producing a field adjacent to the latch end of the door. The field producing assembly is mountable on the latch end of the door, and the field producing assembly is adapted for operatively connecting to the switch of the vehicle such that the field producing assembly produces the field when the switch is actuated by opening of the door. A sensing assembly produces a block signal when an interruption of the field is sensed. The sensing assembly is mountable on the latch end of the door of the vehicle. A blocking assembly is provided for blocking closure of the door when the sensing assembly detects an interruption of the field produced by the field producing assembly. The blocking assembly is mountable on the body of the vehicle adjacent to the door opening. A controller assembly is provided for actuating the blocking assembly upon sensing by the sensing assembly of an interruption of the field produced by the field producing assembly. The controller assembly is connected to the sensing assembly and the blocking assembly.

16 Claims, 7 Drawing Sheets

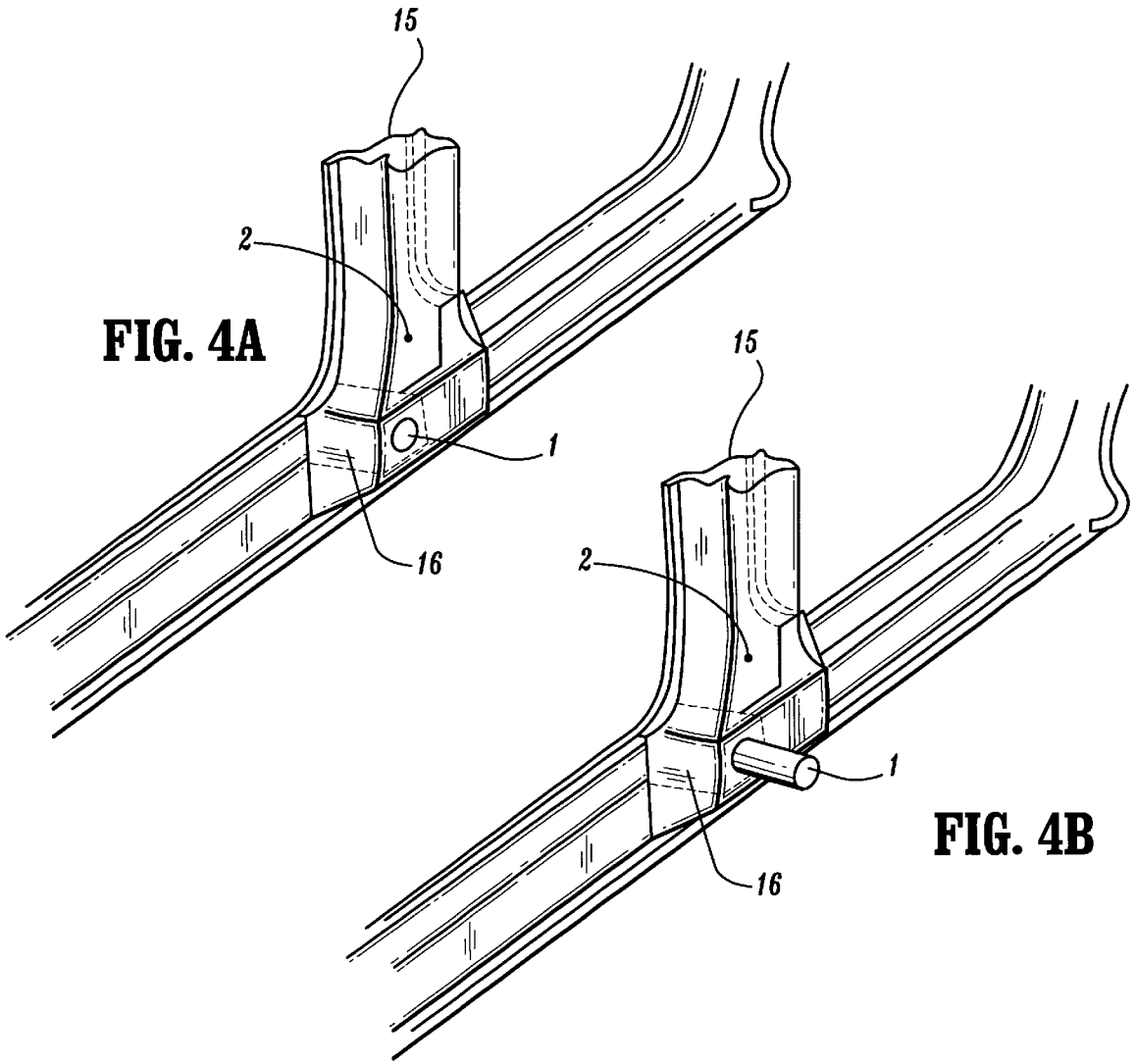
FIG. 4A
FIG. 4B
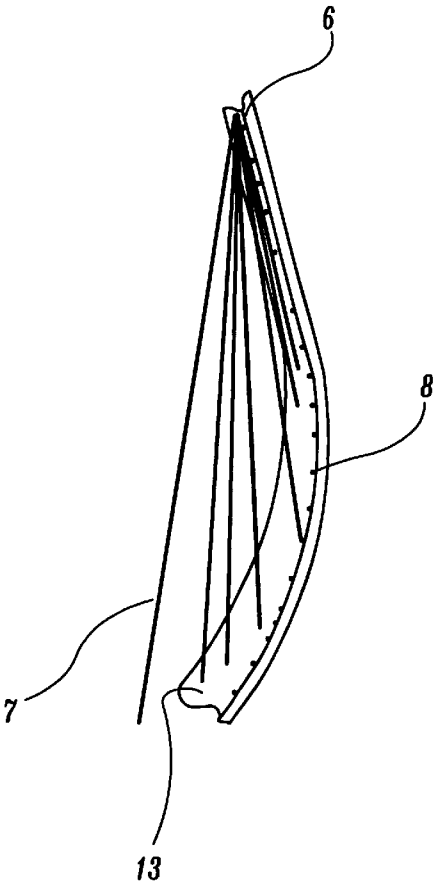
FIG. 3

VEHICLE DOOR STOP SAFETY SYSTEM

CROSS-REFERENCE TO RELATED APPLICATION

This application is a continuation-in-part of application Ser. No. 09/489,121 filed Jan. 21, 2000.

BACKGROUND OF THE INVENTION

1. Field of the Invention

The present invention relates to vehicle door safety systems and more particularly pertains to a new vehicle door stop safety system for preventing closing of a door of a vehicle when an object moves between the open door and the body of the vehicle.

2. Description of the Prior Art

Automobiles are well-accepted vehicles in current science and technology. Current automobiles utilize a main body and at least one door, in addition to hoods over engine compartments and lids over trunks. The main body is usually an elongated, generally rectangular body and the doors extend outwardly therefrom. The doors can be located at virtually any position along the axis of the body. In addition, hoods and trunk lids are generally provided adjacent to the respective forward and rearward ends of the car body for the purpose of covering the engine and trunk compartments.

The doors are, of course, a very important aspect of the automobile in providing a means of ingress and egress to the vehicle. However, the use of the doors expose users, and in particular small children, to hazards such as the inadvertent closing of a door on a hand or the fingers of a hand. This could result in the appendage being crushed or severed by the door.

Likewise, elderly people, or people just not paying attention to what they are doing, may inadvertently close the door on their hand or foot.

Infrared radiation has been used as door passageway sensors in the past. Moreover, fan shaped laser systems, as well as many of the individual components comprising the invention herein addressed, are known. For example, U.S. Pat. No. 5,424,717 discloses a laser light transmitter and proximity detector. Other patents which have been discovered during a patentability search include U.S. Pat. Nos. 5,331,577 and 5,969,603.

However, a need still exists for a vehicle door safety system that monitors and prevents injuries from closing doors on automobiles.

SUMMARY OF THE INVENTION

The present invention provides a new vehicle door stop safety system construction wherein the same can be utilized for preventing closing of a door of a vehicle when an object moves between the open door and the body of the vehicle.

By using a laser device to determine and sense the presence of an obstruction (e.g. a limb) the vicinity of an open door, many hazards (and ensuing injuries) associated with the automotive industry may successfully be avoided. This invention is directed to vehicle sensing devices, in general, and in particular, to devices for sensing the position of a door relative to the buck or jam or slam plate or stanchion or door post portion of the body of the vehicle with the follow-up process of inhibiting an automobile door from closing and very likely causing bodily injury.

To attain this, the present invention generally comprises field producing means for producing a field adjacent to the latch end of the door. The field producing means is mountable on the latch end of the door, and is adapted for operatively connecting to a door actuated switch of the vehicle such that the field producing means produces the field when the switch is actuated by opening of the door. Sensing means is provided for sensing an interruption of the field produced by the field producing means. The sensing means produces a block signal when an interruption of the field is sensed. The sensing means is mountable on the latch end of the door of the vehicle. Blocking means is provided for blocking closure of the door when the sensing means detects an interruption of the field produced by the field producing means. The blocking means is mountable on the body of the vehicle adjacent to the door opening. Controller means is provided for actuating the blocking means upon sensing by the sensing means of an interruption of the field produced by the field producing means. The controller means is connected to the sensing means and the blocking means.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The inventor does not believe that this type of laser technology, in the applications as stated herein, have ever been used in conjunction with a solenoid type doorstop or power cut devices to prevent injury as a result of the momentum of a closing motor vehicle door or hood.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

The objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The foregoing, as well as other features and advantages of the present invention which have not yet been discussed, will be more clearly understood from the following drawings, (in which preferred embodiments of the invention are described):

FIG. 3 is a schematic end view illustrating an automobile door utilizing a fan-shaped laser type of beam, and locations of certain enumerated aspects of the present invention are depicted and follow in close proximity to the inside edge of the automobile door: a fan-shaped laser beam producing device 6, a fan-shaped laser beam 7, and a sensor strip 8 device extending along the inside of the edge of the door 8.

FIGS. 4A and 4B are schematic views illustrating the door post portion 15 of an automobile body with a door closed switch 2. FIG. 4A depicts the doorstop member 1 in a retracted condition. FIG. 4B depicts the doorstop member 1 in an extended condition.

DESCRIPTION OF PREFERRED EMBODIMENTS

With reference now to the drawings, and in particular to FIGS. 1 through 9 thereof, a new vehicle door stop safety system embodying the principles and concepts of the present invention will be described.

The invention comprises an apparatus for monitoring whether an object is positioned so as to obstruct the closure of a door of a vehicle, such as when the hand of a person grips the latch end of the door or is simply positioned between the latch end of the door and the door post portion of the body of the vehicle as the door is in the open position.

Figure 1:
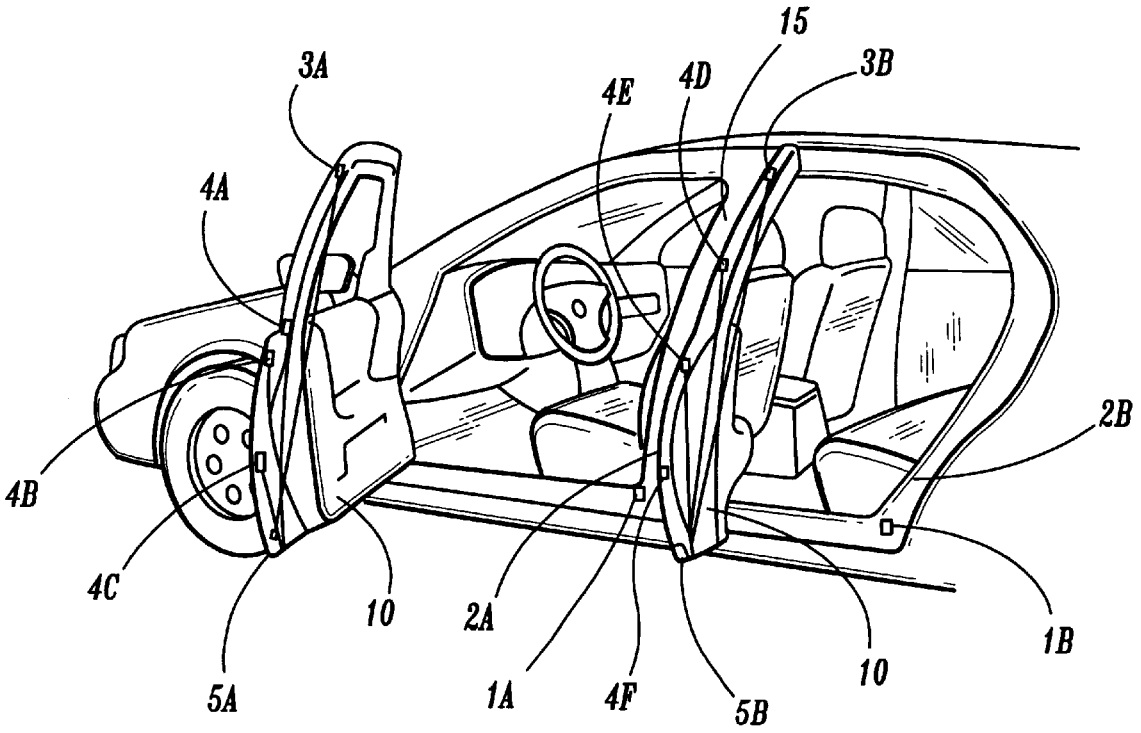
FIG. 1 is a schematic side view illustrating an automobile with doors open and locations of certain enumerated aspects of the present invention are depicted and follow in close proximity to the inside edge of the automobile doors: doorstop members 1A and 1B, switches 2A and 2B, laser beam producing devices 3A and 3B, lenses 4A through 4B, and sensors 5A and 5B.
Figure 2:
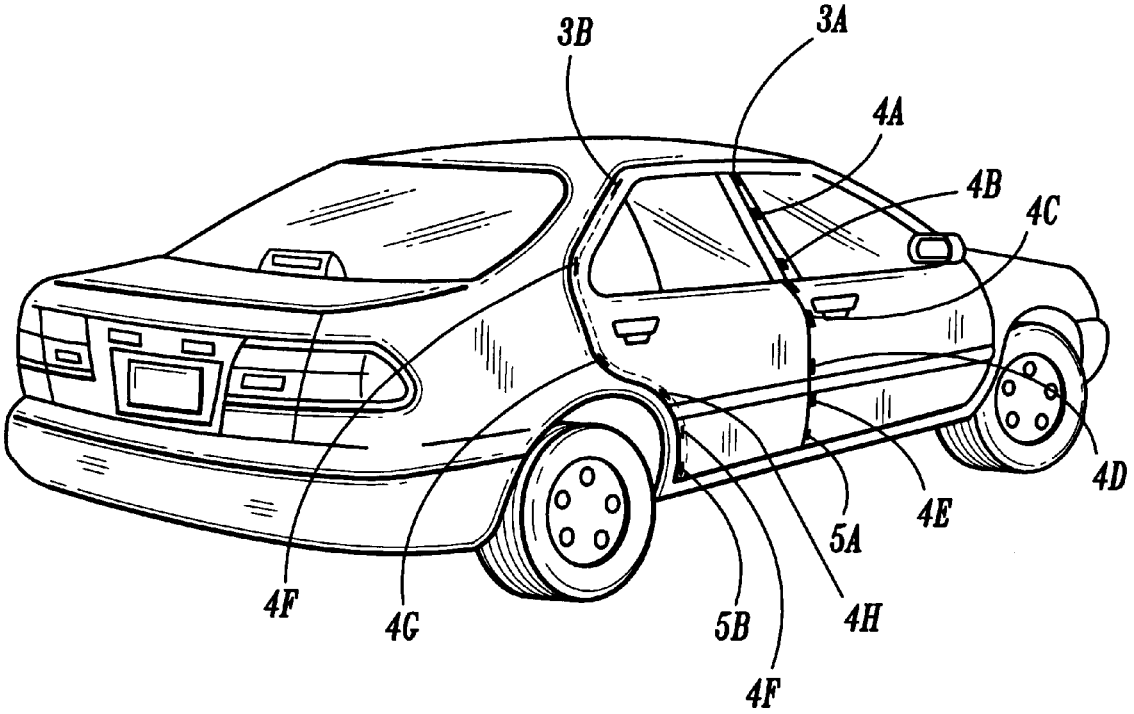
FIG. 2 is a schematic side view illustrating an automobile with doors closed and locations of certain enumerated aspects of the present invention are depicted and follow in close proximity to the outside of the edge of the automobile doors: laser beam producing devices 3A and 3B, lenses 4A through 4I, and sensors 5A and 5B.

As illustrated in FIG. 1, the vehicle is of the type having a body with a door opening formed therein, and a door 10 hingedly mounted to the body adjacent to the door opening such that the door 10 is movable between a closed position in the door opening and an open position away from the door opening. In practice, this may include side doors of automobiles, as well as rear hatch doors and even sliding doors commonly found on minivans. The door has a hinge end and a latch end. The door opening of the body has a door post portion 15 for abutting the latch end of the door 10 when the door 10 is in the closed position. The vehicle further typically has a door closed switch 2 that is actuated when the door of the vehicle is moved out of the closed position, typically by a portion of the door moving out of abutment with a plunger of the switch.

The apparatus includes a field producing means 3 for producing a field adjacent to the latch end of the door. The field producing means may be mountable on the latch end of the door 10, and may be integrated on the vehicle as a part of the vehicle manufacturing practice or may comprise an aftermarket product that is installed after manufacture of the vehicle. The field producing means is adapted for being operatively connected to the door closed switch of the vehicle such that the field producing means produces the field when the switch is actuated by opening of the door, and so that the field is not produced when the door is in the closed position. In the most preferred embodiment, the field producing means generates a field of light for detecting the presence of obstructions. However, the field may also be, for example, comprised of electric or sound waves.

The field producing means includes a light source for producing a beam of light. Preferably, the light source produces a coherent laser light beam. To produce the coherent laser light beam, the light source may comprise at least one light emitting diode. The field producing means further includes a lens assembly for transmitting the beam of light therethrough and for directing the beam to the desired locations. The light assembly comprises at least one lens 4, and the lens 4 is positioned relative to the light source such that the light source shines the light beam through the lens 4. The lens assembly may comprise at least two lenses. The two lenses may be configured such that light from the light source passes through the lenses in tandem, or one after another, with a portion of the light beam being diverted for creating the field of light while another portion of the light beam continues on to the next lens. The non-diverted portion of the light beam may be directed along the interior of the door to another lens, where another portion of the light beam is diverted toward the sensing means. Optionally, the lenses may be configured such that light from the light source passes through the lenses in parallel to create generally parallel beams of light that travel in spaced paths to comprise a portion of the field of light. The lens assembly may include a plurality of refractory lenses 4 for positioning on the latch end of the door 10 to change the direction of the light beam (or portions of the light beam) emanating from the light source such that the light beam travels approximately parallel along an edge of the door at the latch end of the door for directing the light beam toward the sensing means (see, e.g., FIGS. 1 and 2).

Referring now to FIG. 3, in one preferred embodiment of the invention, the lens assembly is adapted such that the field of light comprises a sheet of light 7 created from a light beam emitted by the light source 6. Preferably, the sheet of light is substantially fan-shaped and radiates outwardly from the lens assembly substantially in a plane. The lens assembly may include an aperture that is adapted to divide the light beam from the light source into a plurality of light beams forming the fan-shaped sheet of light. The sheet of light may be an approximately 5 mm thick fan-shaped sheet which may extend over a divergence angle of about 40 degrees. The lens assembly is mountable on an upper location of the latch end of the door 13 so as to project the substantially fan-shaped sheet of light in a downward direction toward a lower location on the door 13. The light source 6 may be mounted in a manner such that the plane of the substantially fan-shaped sheet of light 7 is oriented substantially perpendicular to an axis of the door 13 that extends between the hinge end and latch end of the door. While the light beam, or sheet of light, may be directed in directions other than downward, the downward direction of the light beam reduces the chance that the light beam will be directed into the eyes of persons standing adjacent to the door of the vehicle.

The field producing means may also include control circuitry for connecting to the switch of the vehicle and the light beam producing diode. The control circuitry is thus able to cause the field producing means, or laser diodes, to produce the field of light when the switch is actuated by opening of the door.

The sensing means is provided for sensing an interruption of the field produced by the field producing means, such as by a hand or other object. The sensing means is mountable on the latch end of the door of the vehicle, or may be integrated in such position during the vehicle manufacture process. The sensing means is adapted to produce a block signal when an interruption of the field is sensed. In one embodiment of the invention, the sensing means comprises at least one light sensor 5 for mounting on the latch end of the door (see FIG. 1). Optionally, a plurality of light sensors may be mounted in a spaced linear array configuration along the latch end of the door for detecting portions of the sheet of light produced by the field producing means. The plurality of light sensors are preferably electrically connected in a series circuit such that any one of the sensors detecting an obstruction will produce the block signal. Optionally, a substantially continuous sensor strip 8 may be provided which is mountable on the latch end of the door of the vehicle (see FIG. 3).

Significantly, the blocking means is provided for blocking closure of the door when the sensing means detects an interruption of the field produced by the field producing means. The blocking means may be mountable on the body of the vehicle adjacent to the door opening (although it is within the scope of the invention to have the blocking means mounted on the door of the vehicle for performing the same function).

As illustrated in FIGS. 4A and 4B, the blocking means comprises a solenoid 16 that may be mounted on the door post portion of the body of the vehicle. A doorstop member 1 is selectively extendable from the solenoid 16. The doorstop member 1 has an extended position (see FIG. 4B) wherein the doorstop member 1 is extended so as to prevent the door of the vehicle from moving into the closed position in the door opening, and the doorstop member 1 has a retracted position (see FIG. 4A) wherein the doorstop member does not obstruct the door from moving into the closed position.

Figure 5:
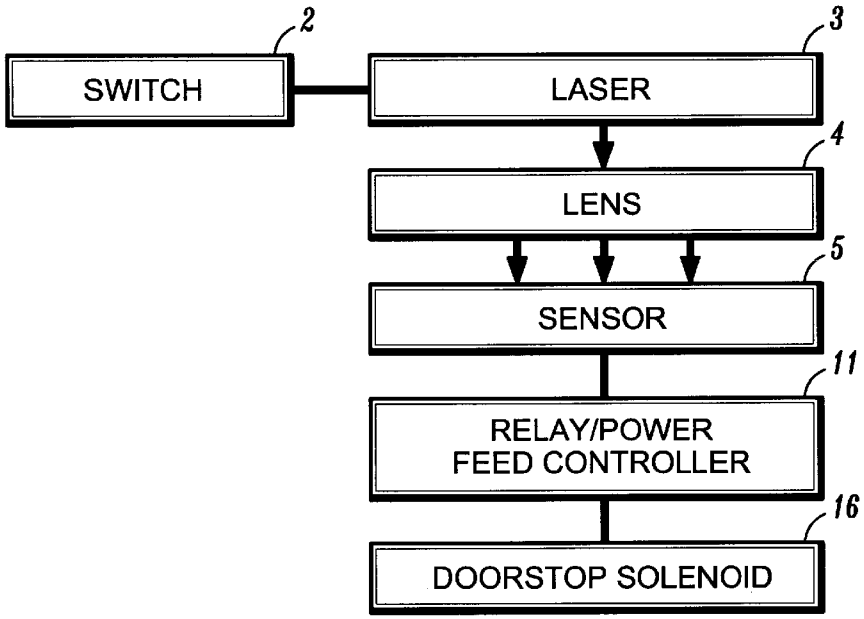
FIG. 5 is a basic schematic block diagram of the present invention with respect to the power feed controller 11.
Figure 6:
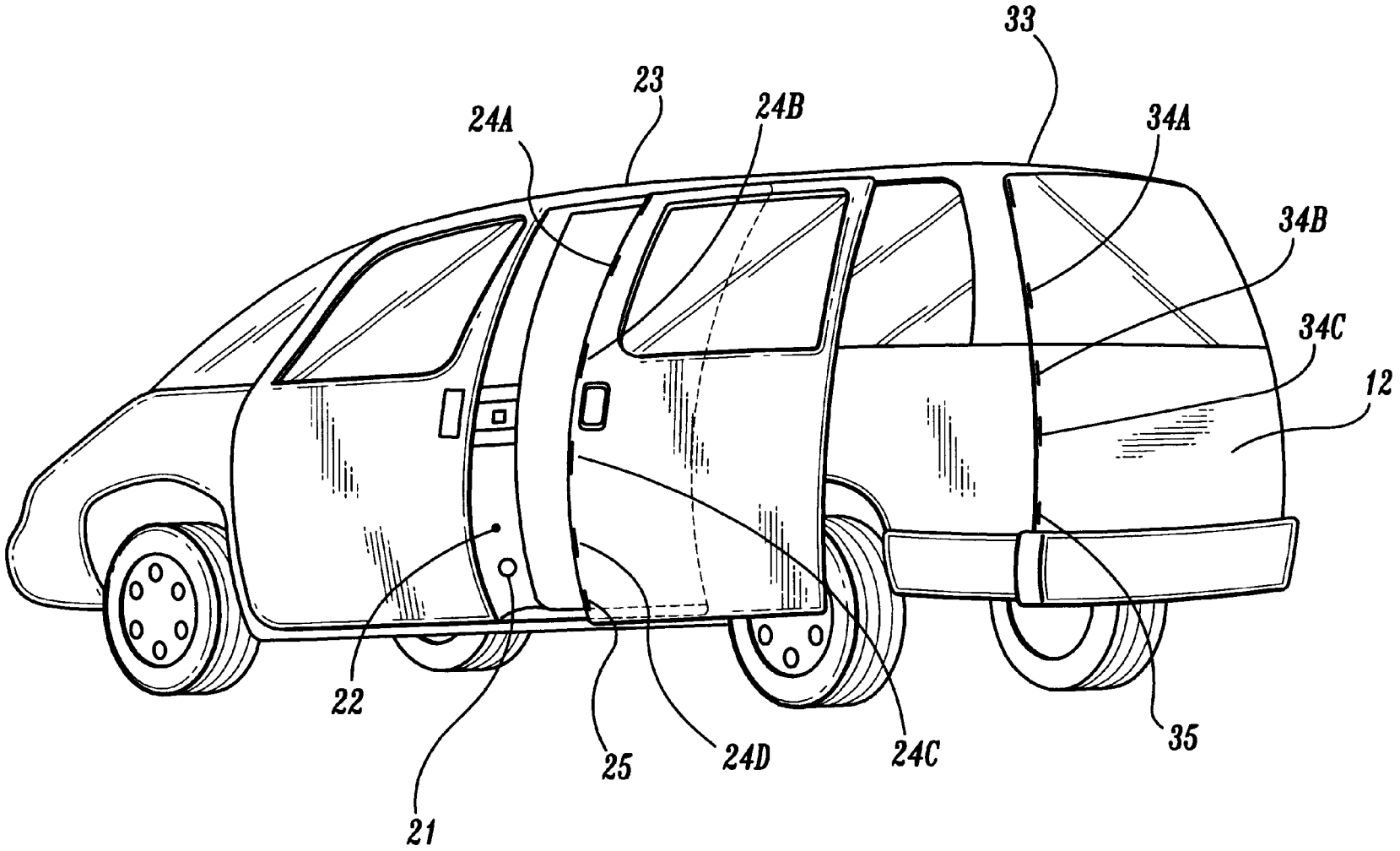
FIG. 6 is a schematic side view illustrating a minivan type vehicle with the rear cargo hatch 12 closed and the side sliding passenger door partially open and the door post portion exposed with locations of certain enumerated aspects of the present invention depicted: a doorstop member 21; a switch 22; laser beam producing devices 23 and 33, lenses 24A through 24D and 34A through 34C, and sensors 25 and 35.
Figure 7:
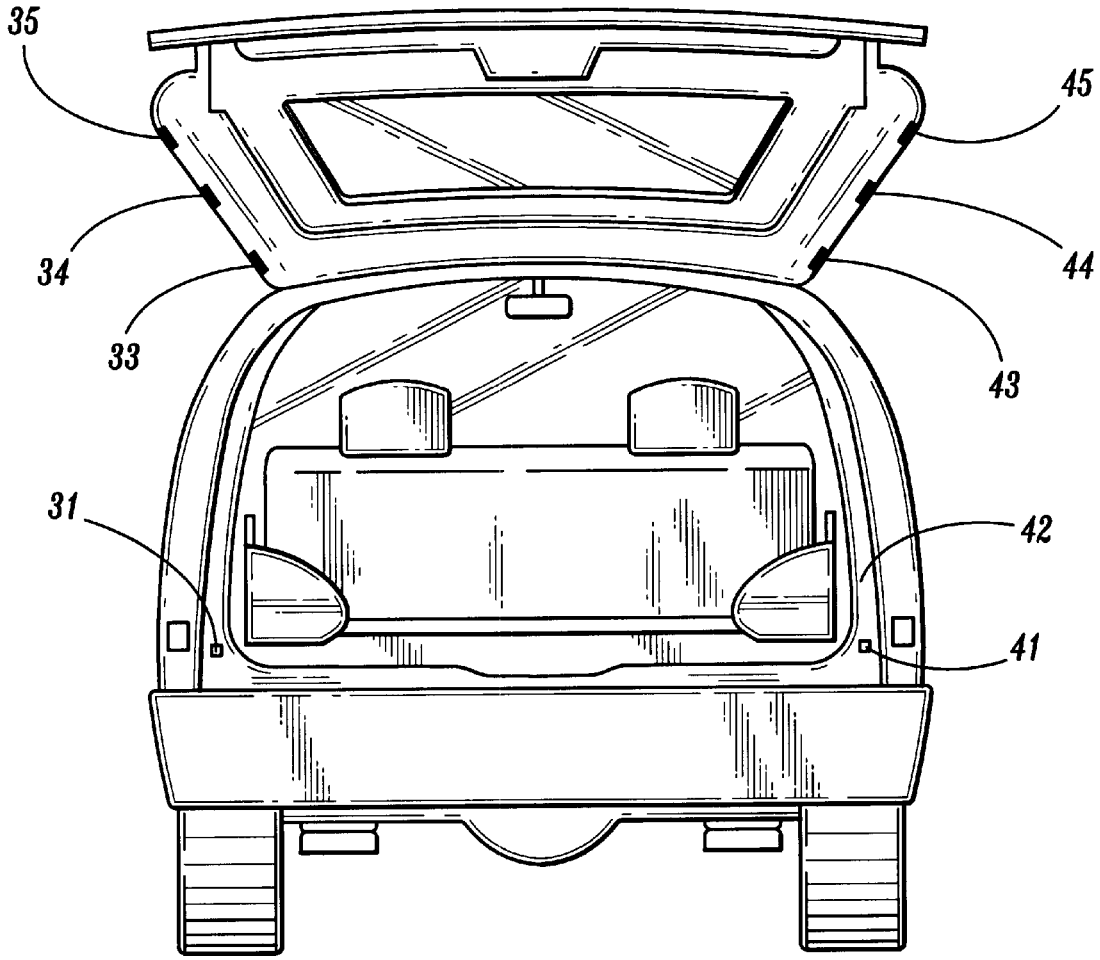
FIG. 7 is a schematic view illustrating a minivan type vehicle cargo hatch in the open position with locations of certain enumerated aspects of the present invention depicted: doorstop members 31 and 41, switch 42, laser beam producing devices 33 and 43, lenses 34 and 44, and sensors 35 and 45.
Figure 8A:
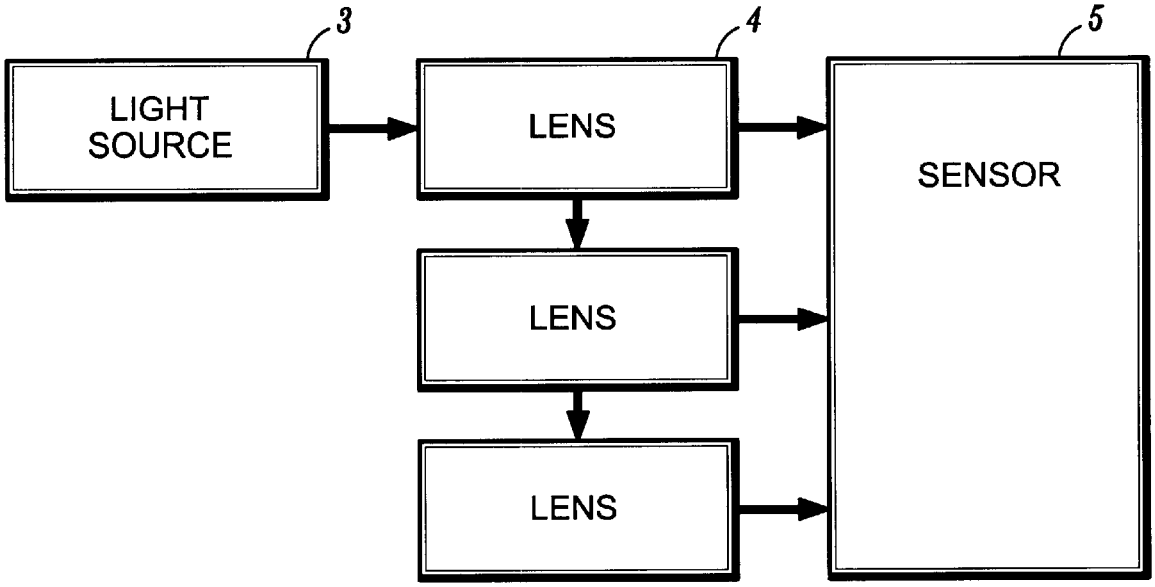
FIGS. 8A and 8B are schematic block diagrams illustrating the light producing assemblies and sensors.
Figure 8B:
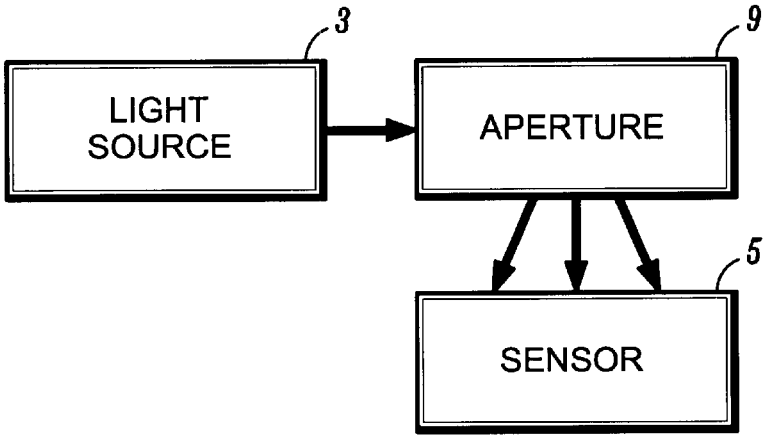

Controller means may be provided for actuating the blocking means upon sensing by the sensing means of an interruption of the field produced by the field producing means. The controller means is connected to the sensing means and the blocking means. As illustrated in FIG. 5, in one embodiment of the invention, the controller means comprises a relay/power feed controller 11 connected to the solenoid 16 such that the controller 11 may selectively energize the solenoid 16 to move the doorstop member 1 into the extended position.

Figure 9A:
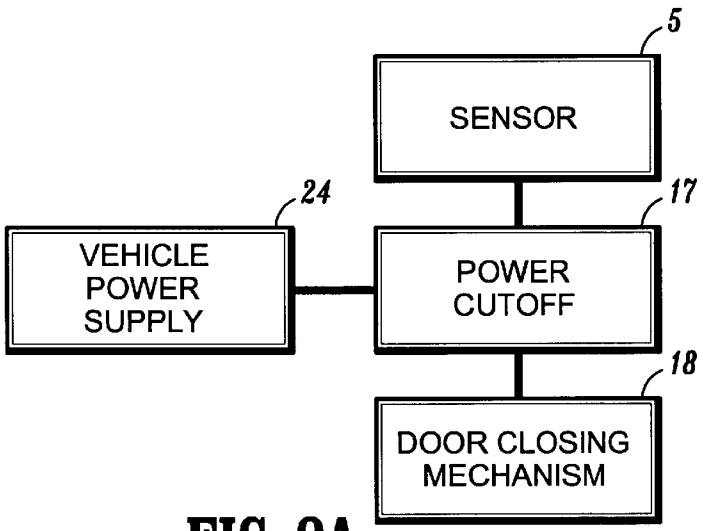
FIGS. 9A and 9B are schematic block diagrams of optical applications of the system of the invention to sliding door closure mechanisms and window closing mechanisms.

Optionally, as illustrated in FIG. 9A, power cutting means 17 may be provided for cutting power to a closing mechanism 18 adapted for automatically closing the door, such as a sliding door on a minivan type of vehicle. The power cutting means 17 is connectable between a power supply 24 of the vehicle and the closing mechanism, and the power cutting means 17 is adapted to provide power to the closing mechanism 18 under normal conditions, while interrupting the supply of power to the closing mechanism when an obstruction is detected and continuing the interruption until the obstruction is removed from the field.

Figure 9B:
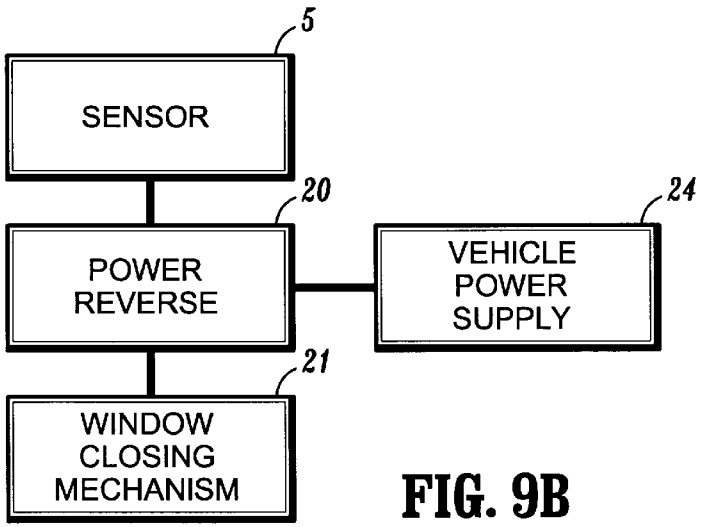

Retracting means may be provided for retracting (or opening) a window upon sensing by the sensing means of an obstruction of the field produced by the field producing means. As illustrated in FIG. 9B, the retracting means may take the form of a power reversing circuit 20 that provides the necessary polarity of power to the window closing mechanism 21 to operate the mechanism in the "open" direction. The sensor means would most preferably be oriented adjacent to the window opening for detecting the presence of a hand in the opening of the window.

Optionally, modulating means may be provided for causing the light beam from the light source to be modulated at a predetermined frequency. Signal processing means may be provided that is responsive to proximity signals (produced by the sensor means) for producing an output to signify the presence of an object intercepting the light beam. The signal processing means may include synchronous detecting means, driven by the modulating means, for detecting the proximity signals so as to reduce or eliminate noise in the signals. Comparator means may be provided to compare the detected proximity signals with a reference signal to produce an output. The proximity signals may be transmitted in parallel to receptor diodes to act as a backup in the event of fault of receptivity by the sensor means.

It should be realized that the type of automobile on which the invention is employed is not critical, nor is the arrangement and/or type of door. Further, while not specifically shown or described, the same system with the operation discussed hereinabove, can be applied to a rear cargo door, a front engine hood or a rear trunk lid.

It should be understood that, while a particular illustrative embodiment shown and described herein utilizes a laser light source, the light source may be replaced by any suitable type of signal-generating mechanism. For example, in some instances, an electromagnetic wave, a microwave, a radio beam or any other suitable signal projection device can be utilized. Likewise, the sensing mechanism can be a light-receiving or light-sensitive device, an electromagnetic beam sensitive device, or the like.

The specific mounting devices and techniques are omitted for clarity. Additionally, the positioning of the detectors and the signal generators can be positioned in other locations. For example, the signaling device may be placed on the vehicle body with the detector also mounted on the body. However, while it is believed that operations of such a configuration would probably be more difficult to implement and to calibrate, this configuration is contemplated by the instant invention. As noted, the sensors and/or sensor apparatus can take any number of suitable or desirable forms and configurations. Moreover, the energy source or light source (laser) or the solenoid door stop may be located anywhere on the door or door post portion of the automobile body. It is believed that the edge of the end of the door is the most appropriate place for mounting the signal source in order to most efficiently and quickly sense interference with a closing door such that the doorstop may be effectively extended to prevent closing of the door and causing injury to persons or objects lying in the path of the closing door.

It should be further noted that the representations shown herein are for convenience and are not intended to depict the entire automobile. Along these lines, the design of existing automobiles need not be altered in any fashion to accommodate said invention. Moreover, the components of the automobiles and associated parts (as shown in the above drawings) are intended to be representational only and are not limitative of the invention.

Although the present invention has been illustrated and described with reference to a preferred embodiment thereof, it should be understood that it is in no way limited to the details of such embodiment but is capable of numerous modifications within the scope of the appended claims. Therefore, there is shown and described a unique design and concept of a laser operated doorstop system. The particular configuration shown and described herein relates to devices for sensing the presence of an object in proximity of a closing car door relative to its jamb located on the car body. While this description is directed to a particular embodiment, it is understood that those skilled in the art may conceive modifications and/or variations to the specific embodiments shown and described herein. Any such modifications or variations which fall within the purview of this description are intended to be included therein as well. It is understood that the description herein is intended to be illustrative only and is not intended to be limitative. Rather, the scope of the invention described herein is limited only by the claims appended hereto.

What is claimed is:

1. A system for monitoring whether an object is positioned so as to obstruct the closure of a door of a vehicle, the vehicle being of the type having a body with a door opening formed therein and a door hingedly mounted adjacent to the door opening such that the door is movable between a closed position in the door opening and an open position away from the door opening, the door having a hinge end and a latch end, the door opening of the body having a door post portion for abutting the latch end of the door, the vehicle further having a switch that is actuated when the door of the vehicle is moved out of the closed position, the system comprising:

field producing means for producing a field adjacent to the latch end of the door, the field producing means being mountable on the latch end of the door, the field producing means being adapted for operatively connecting to the switch of the vehicle such that the field producing means produces the field when the switch is actuated by opening of the door;

sensing means for sensing an interruption of the field produced by the field producing means, the sensing means producing a block signal when an interruption of the field is sensed, the sensing means being mountable on the latch end of the door of the vehicle;

blocking means for blocking closure of the door when the sensing means detects an interruption of the field produced by the field producing means, the blocking means being mountable on the body of the vehicle adjacent to the door opening; and controller means for actuating the blocking means upon sensing by the sensing means of an interruption of the field produced by the field producing means, the controller means being connected to the sensing means and the blocking means.

2. The system of claim 1 wherein the field producing means generates a field of light.

3. The system of claim 2 wherein the field producing means comprises a light source for producing a coherent laser light beam.

4. The system of claim 2 wherein the field producing means comprises a lens assembly for transmitting the beam of light therethrough.

5. The system of claim 4 wherein the lens assembly is adapted such that the field of light comprises a sheet of light created from light beam emitted by the light source, the sheet of light being substantially fan-shaped and radiating outwardly from the lens assembly substantially in a plane.

6. The system of claim 5 wherein the lens assembly includes an aperture adapted to divide the light beam from the light source into a plurality of light beams forming the fan-shaped sheet of light.

7. The system of claim 4 wherein the lens assembly is mountable on an upper location of the latch end of the door so as to project the substantially fan-shaped sheet of light in a downward direction toward a lower location on the door.

8. The system of claim 2 wherein the sensing means comprises a plurality of light sensors for mounting on the latch end of the door for detecting light produced by the field producing means.

9. The system of claim 2 wherein the sensing means comprises a substantially continuous sensor strip mountable on the latch end of the door of the vehicle.

10. The system of claim 2 wherein the blocking means comprises a solenoid for mounting on a door post portion of the body of the vehicle, the solenoid having a doorstop member selectively extendable from the solenoid, the doorstop member having an extended position wherein the doorstop member is extended so as to prevent the door of the vehicle from moving into the closed position in the door opening, the doorstop member having a retracted position wherein the doorstop member does not obstruct the door from moving into the closed position.

11. The system of claim 10 wherein the controller means comprises a relay/power feed controller being connected to the solenoid for selectively energizing the solenoid to move the doorstop member into the extended position.

12. The system of claim 1 wherein the field producing means generates a field of light;

wherein the field producing means comprises a light source for producing a coherent laser light beam;

wherein the field producing means comprises a lens assembly for transmitting the beam of light therethrough;

wherein the lens assembly is adapted such that the field of light comprises a sheet of light created from light beam emitted by the light source, the sheet of light being substantially fan-shaped and radiating outwardly from the lens assembly substantially in a plane;

wherein the lens assembly includes an aperture adapted to divide the light beam from the light source into a plurality of light beams forming the fan-shaped sheet of light;

wherein the lens assembly is mountable on an upper location of the latch end of the door so as to project the substantially fan-shaped sheet of light in a downward direction toward a lower location on the door;

wherein the sensing means comprises a plurality of light sensors for mounting on the latch end of the door for detecting light produced by the field producing means;

wherein the blocking means comprises a solenoid for mounting on a door post portion of the body of the vehicle, the solenoid having a doorstop member selectively extendable from the solenoid, the doorstop member having an extended position wherein the doorstop member is extended so as to prevent the door of the vehicle from moving into the closed position in the door opening, the doorstop member having a retracted position wherein the doorstop member does not obstruct the door from moving into the closed position; and wherein the controller means comprises a relay/power feed controller being connected to the solenoid for selectively energizing the solenoid to move the doorstop member into the extended position.

13. An apparatus for monitoring and preventing injury caused by a closing automobile door comprising:

a contact switch for supplying a signal when the door is opened;

a signal producing laser light transmitter including a lens transparent to laser light and a laser light emitting diode at a focal point of the lens, wherein a surface of the lens produces a fan-shaped sheet of laser light from said laser light emitting diode;

at least one signal sensing means mounted on adjacent to the inside edge of the door from the top incrementally to the bottom to receive light from said laser light transmitter;

a relay/power feed controller wherein when said relay/power feed controller is energized it energizes a solenoid that deploys a doorstop out of a corresponding doorpost to prevent the door from closing completely.

14. An apparatus to prevent an automobile door from closing comprising:

a contact switch for supplying a signal when the door is opened;

one signal producing laser light transmitter directed toward at least one signal sensing means;

at least one refractory lens positioned on an inside edge of the door to change a direction of a light beam from said signal producing laser light transmitter to follow approximately parallel along the shape of the door and ultimately direct said light beam toward the at least one signal sensing mean; said at least one laser light transmitter being mounted on one end of an inside edge of the door adjacent to the edge of the door which swings closed against the stanchion to which it locks; said at least one refractory lens mounted to follow the edge of the door with the beam of light which will be ultimately directed toward said signal sensing means which is mounted on the opposite edge of the door when said beams of laser light are broken will trigger a relay/power feed controller to energize a solenoid that deploys a doorstop out of the door post to prevent the door from closing completely.

15. The apparatus as recited in claim 14 further comprising:

control circuitry connected to an open door switch for energizing the laser light in response to an indication of an open door.

16. The apparatus as recited in claim 14 wherein, said at least one signal sensing means includes a matrix of detector devices arranged electrically in series circuit and mechanically in a matrix having at least one row and at least one column.

* * * * *